United States Patent [19]

Carter

[11] 4,227,068

[45] Oct. 7, 1980

[54] CONVECTOR HEATER

[75] Inventor: Brian Carter, Paris, France

[73] Assignee: Societe PRL, Aubervilliers, France

[21] Appl. No.: 924,832

[22] Filed: Jul. 14, 1978

Related U.S. Application Data

[63] Continuation-in-part of Ser. No. 924,091, Jul. 12, 1978, abandoned, which is a continuation of Ser. No. 770,760, Feb. 12, 1977, abandoned.

[30] Foreign Application Priority Data

Feb. 20, 1976 [GB] United Kingdom ..... 6880/76

[51] Int. Cl.[3] ..... F24H 3/00

[52] U.S. Cl. ..... 219/366; 165/129; 174/52 R; 219/342; 219/357; 219/379; 312/236

[58] Field of Search ..... D23/113-115; 219/341, 342, 344, 350, 351, 352, 363-368, 376; 165/55, 128, 129; 237/79; 361/422, 380; 174/52 R; 334/88; 312/245, 223, 214, 236

[56] References Cited

U.S. PATENT DOCUMENTS

| | | | |
|---|---|---|---|
| D. 195,447 | 6/1963 | Ware | D23/113 |
| D. 198,556 | 6/1964 | Miller et al. | D23/113 |
| 1,154,412 | 9/1915 | Kuhn et al. | 219/376 |
| 1,708,237 | 4/1929 | Pioch | 219/344 |
| 1,927,991 | 9/1933 | Pendleton | 219/341 |
| 2,122,454 | 7/1938 | Child | 237/79 |
| 2,423,974 | 7/1947 | Hamblin | 165/129 |
| 2,436,288 | 2/1948 | Capra | 219/366 |
| 2,568,493 | 9/1951 | Garrison | 219/376 |
| 2,641,679 | 6/1953 | Brodbeck | 219/363 |
| 2,765,393 | 10/1956 | Theisen | 219/364 |
| 3,769,494 | 10/1973 | Janson | 219/363 |

FOREIGN PATENT DOCUMENTS 459226 2/1978 Spain .

*Primary Examiner*—Roy N. Envall, Jr.
*Assistant Examiner*—Bernard Roskoski
*Attorney, Agent, or Firm*—Wenderoth, Lind & Ponack

[57] ABSTRACT

A convector heater having a cabinet containing a heat exchanger. The heater is supported at the rear and thereby mounted to a wall. A manual control for the heater is situated at a rebate at the rear edge of the cabinet so as to be manually accessible and yet not readily visible from the front.

17 Claims, 9 Drawing Figures

CONVECTOR HEATER

This application is a continuation-in-part of application Ser. No. 924,091, filed July 12, 1978, now abandoned, which was a continuation of application Ser. No. 770,760, filed Feb. 12, 1977, now abandoned.

The invention relates to a convector heater, and in particular to a convector heater having a cabinet.

BACKGROUND AND SUMMARY OF INVENTION

A convector heater generally has a manual control whereby the heater may be controlled. In the case of a convector heater which is mounted at the rear on a wall it has been customary to provide the manual control on the front or side of the cabinet. This is unsatisfactory aesthetically since the line of the cabinet is spoiled and the control is often visually obtrusive.

An object of the invention is to provide an improved convector heater wherein the manual controls are provided in a rebate at the rear of the cabinet.

A further object of the invention is to provide a convector heater wherein the manual operators are invisible from the front of the cabinet.

According to the invention there is provided a convector heater comprising a cabinet having a heat exchanger; means for mounting the cabinet at the rear thereof; and manual control means for controlling the heater. The cabinet, at least when it is mounted for use to a wall, has a rebate at the rear edge of the cabinet and the manual control means are situated at the rebate so as to be manually accessible and yet not readily visible from the front. Conveniently, the cabinet is of a generally rectangular box shape and the heat exchanger is electrically powered.

Preferably the mounting means is a pair of vertically-extending channel supports for fixing to the wall and for supporting the cabinet with its rear spaced from the wall. The rebate is thus defined by one of the supports and a portion of the rear of the cabinet adjacent to the edge thereof.

The convector heater preferably has a thermostat and the manual control means includes a control for the thermostat which is preferably a thumb wheel. Alternatively, however, this may comprise a sliding control. Preferably there is a window in the top or side of the cabinet whereby the setting of the manual control may be seen.

Preferably the cabinet also has a rear-wardly facing recess at one side which houses the control and a temperature sensitive bulb for the thermostat. With this arrangement the bulb is shielded from the flow of heated air and is subjected to ambient air temperature. In accordance with a preferred feature of the present invention there are provided one or more holes in the inner wall of the recess. Thus, if there is a blockage of the normal air flow by an object being placed on the normally provided grill at the top of the cabinet, for example, then hot air will be deflected through the hole and over the bulb.

This will heat the bulb to cut off the heat supply to the heat exchanger, and a thermal cut-off device can thereby be obviated.

A suitable heat exchanger is that heat exchanger described in pending United States patent application Ser. No. 762,186. In particular the electrically operated heat exchanger of that application is preferred.

BRIEF DESCRIPTION OF THE DRAWINGS

In order that the invention may be more readily understood two embodiments will now be described with reference to the accompanying drawings, in which.

DETAILED DESCRIPTION OF THE DRAWINGS

Figure 1:
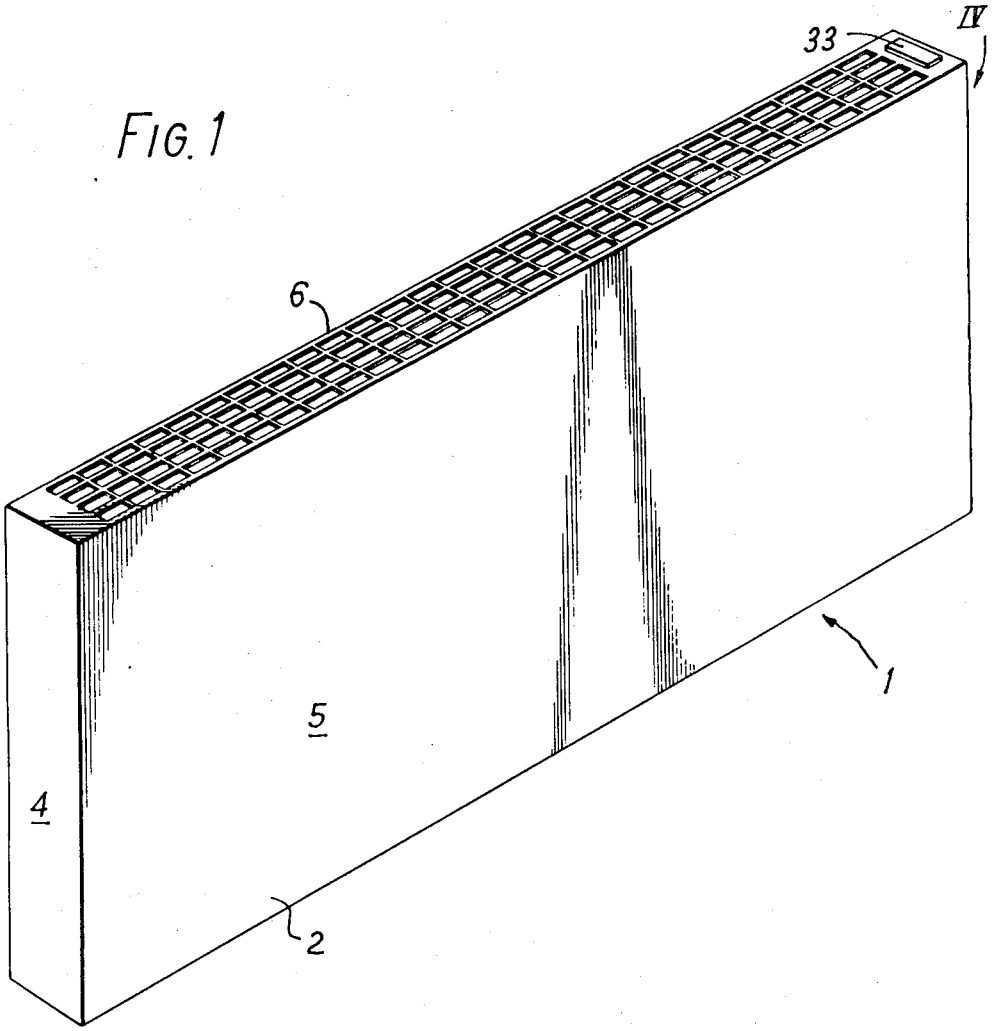
FIG. 1 is a front perspective view from above of a cabinet of one convector heater in accordance with the invention.
Figure 2:
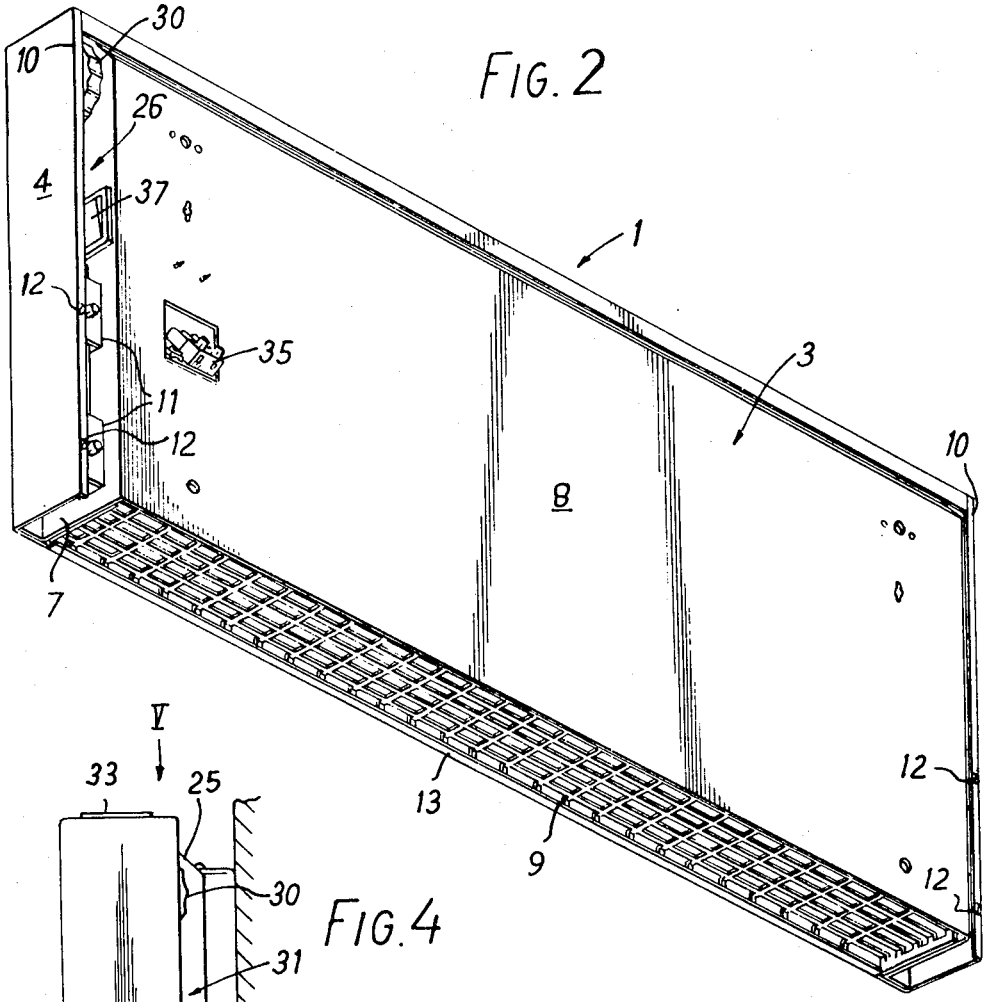
FIG. 2 is a rear perspective view from below of the cabinet of FIG. 1.

Referring now to the drawings and FIG. 1 in particular, the convector heater has a cabinet 1. The cabinet has a front metal pressing 2 and a rear metal pressing 3 (see FIG. 2). The front pressing has outer sidewalls 4 integral with a front panel 5. A top grill 6 is welded to the front pressing. The rear pressing has inner sidewalls 7 integral with a back panel 8. A bottom grill 9 (see FIG. 2) is welded to the rear pressing. The two pressings 2,3 are simply assembled together by sliding the front pressing down over the rear pressing. Flanges 10 provided at the back of the outer sidewalls engage outside tabs 11 pushed out from the inner sidewalls 7. The engagement of the front edges of the inner sidewalls with the front panel 5 co-operates with the engagement of the flanges 10 with the tabs 11 to maintain the relative position of the front and rear panels 5, 8. The engagement of the top of the rear panel with the top grill 6 determines the vertical alignment of the panels. The pressings are held by self-tapping screws 12, which secure the tabs 11 to the flanges 10. As an added measure the bottom of the front panel is provided with a flange 13 which must be sprung over the front edge of the bottom grill on assembly of the two pressings.

Figure 4:
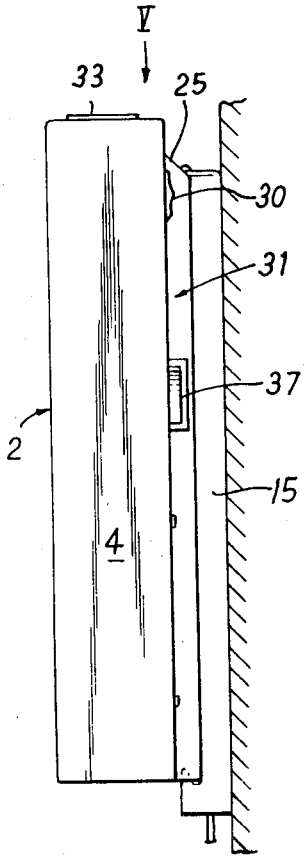
FIG. 4 is an end view in direction of arrow IV in FIG. 1, showing the cabinet mounted to a wall.
Figure 7:
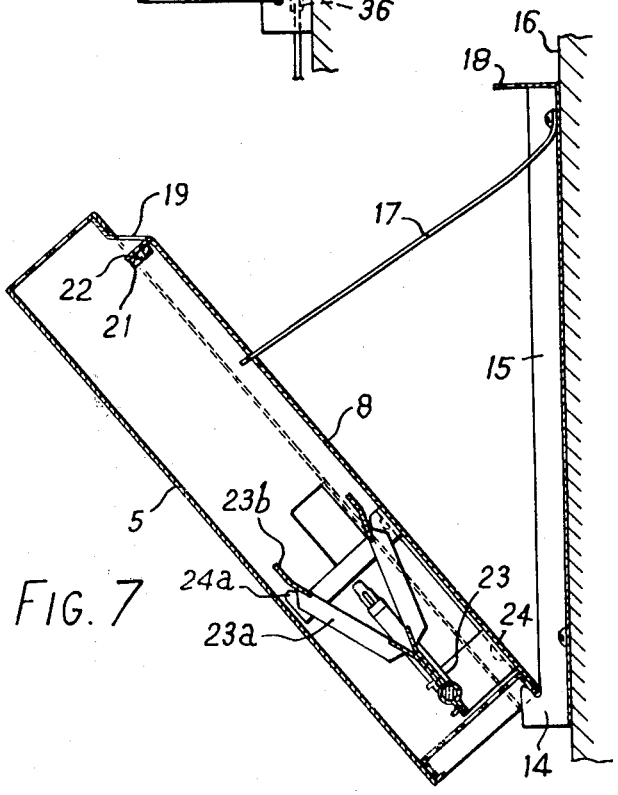
FIG. 7 is a cross-section of the cabinet taken on the line VII—VII in FIG. 3, showing the cabinet swung down from the wall for access.

In FIG. 7 the cabinet is shown resting, via the bottom of the rear panel 8, on bearers 14 which are integral with two vertically-extending channel supports 15. These supports are screwed to a wall 16. Nylon straps 17, which are slotted into the rear panel 8 at their outer ends and are screwed at their inner end to the supports near their upper ends and to the wall, support the cabinet 1 in its swung-down position. Tabs 18 provided at the top of the supports 15 engage in holes 19 at the top of the rear panel 8 when the cabinet is pushed up to its operative position, as shown in FIG. 4. Screws 20 engaging in screwed bushes 21 secure the tabs 18 to tabs 22 which are pressed out of the holes 19, thus the cabinet is held in its operative position.

Figure 3:
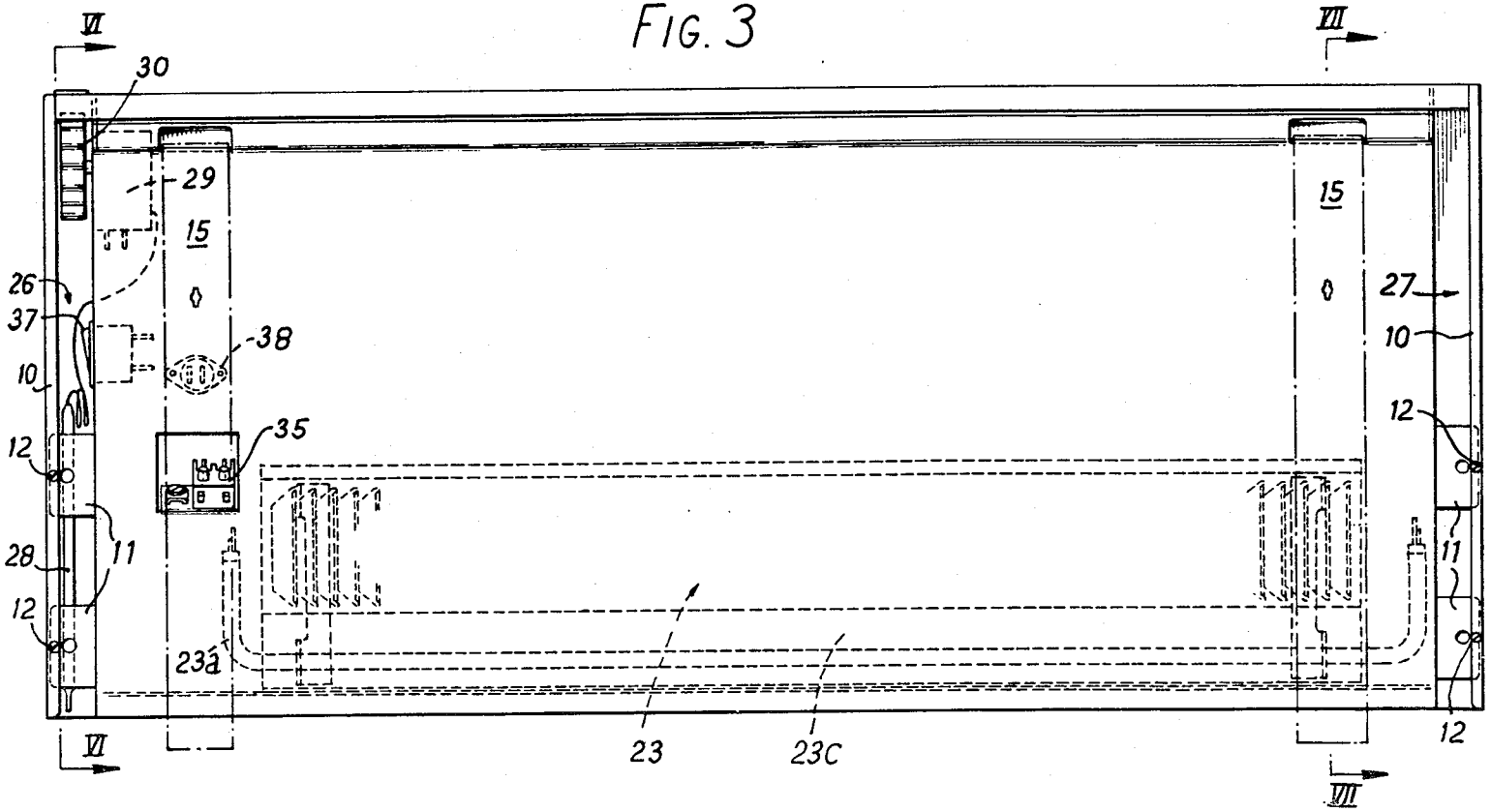
FIG. 3 is a rear elevation of the cabinet.

A heat exchanger 23, seen dotted in FIG. 3, is mounted inside the cabinet 1. The heat exchanger is of the kind specifically described in application Ser. No. 762,186 and comprises an elongate tubular sheathed electrical heating element surrounded by a spine. The spine has a pair of banks of fins projecting upwardly therefrom in Vee formation. The fins are all parallel, those in each bank facing each other. The tops of the fins in each bank are joined by a strip running the length of the bank. The fins 23*a* and the strips 23*b* can be seen in FIG. 7 and the spine 23*c* and heating element 23*d* are best seen, though dotted, in FIG. 3. The heat exchanger is mounted via the spine 23*c* by brackets 24 to the rear panel 8. These brackets are provided with a cradle 24*a* for the strips 23*a* and twist tabs 24*b*, which engage in holes in the spine 23*c*.

When in use the heat exchanger 23 dissipates heat from the fins 23*a*, thus causing an upward convection flow. This flow will have entrained therein dust, some of which will come to rest on the wall above the convector thereby soiling the wall. In order to reduce this effect, the top of the rear panel 8 has a deflector 25 integral therewith which slopes away from the wall, as best seen in FIG. 4. This helps deflect the rising hot air forwardly and reduces the soiling of the wall by the dust.

Figure 5:
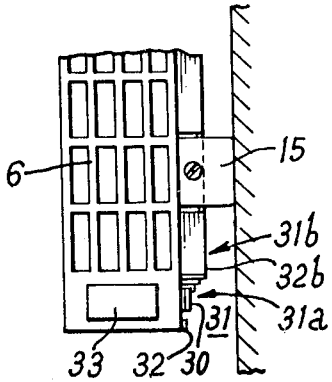
FIG. 5 is a top view in the direction of the arrow V in FIG. 4 showing the end of the cabinet and a rebate at the rear thereof.

The inner and outer sidewalls 7, 4 define therebetween recesses 26, 27 at respective ends of the cabinet (see FIG. 3). In the right-hand (when viewed from the front) recess 26 there is mounted on the tabs 11, via insulated nylon brushes, a bulb thermostat 28, best seen in FIGS. 3, 6, which co-operates with a control box 29, mounted within the cabinet at the top right-hand corner thereof (when viewed from the front), to control the current supply to the element of the heat exchanger 23. At the top of the recess 26 there is provided a manual control comprising a thumb wheel 30 with a scalloped periphery. Rotation of the thumb wheel sets the temperature at which the thermostat will switch off the power to the heat exchanger 23. The thumb wheel 30 is accessible only from the rear of the cabinet for manual setting of the thermostat. There is a rebate 31 (see FIGS. 4, 5) provided at the right-hand rear edge of the cabinet.

The thumb wheel 30 projects into the rebate 31 and is thereby accessible but not readily visible from the front. The rebate 31 is in fact a combined rebate, partly formed by a small rebate 31*a* in the cabinet at the rear edge 32 and partly 31*b* defined by the channel support and a portion 32*b* of the cabinet adjacent to the small rebate. A window with a lens 33 is provided in the top grill immediately above the thumb wheel 30 for viewing settings marked on the periphery of the thumb view. The lens 33 magnifies the periphery of the thumb wheel, so that only a short portion of the periphery and the settings can be seen at any one time.

Figure 6:
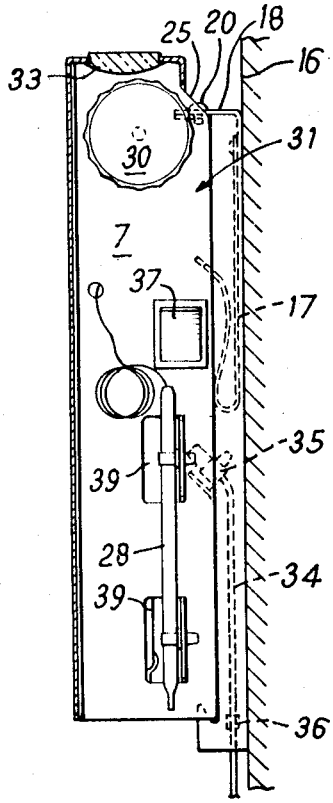
FIG. 6 is a cross-section of the cabinet taken on the line VI—VI in FIG. 3 showing the cabinet mounted to the wall.

Electric power is supplied to the convector heater via a cable 34 (see FIG. 6). The cable is connected via connector 35 to internal wiring in the heater. The connector is attached to the rear panel 8 on a tab pushed out from the panel at such an angle that the connector is easily accessible to an electrician connecting the cable when the cabinet is in its swung-down position. The junction of the cable 34 and the connector 35 is protected by the right-hand channel support 15 when the cabinet is swung up to its operative position. The cable enters the channel through hole 36.

An ON/OFF switch 37 is provided below the thumb wheel 30. Also provided in the electric circuit of the heater, is an automatic safety cut-out switch 38. This switch is mounted on and responsive to the temperature of the rear panel 8. Thus, if, for instance, the top grill 6 is partially obstructed and the temperature of the rear panel rises the cut-out switch 38 will automatically switch off the power to the heat exchanger. The thermostat can also operate as a safety cut-out. In normal operation there is sufficient flow of air in the recess 26 to maintain the bulb 28 at ambient temperature. However, if the top grill is partially obstructed heated air from the heat exchanger will flow through holes 39, whence the tabs 11 have been pressed. This air will raise the temperature of the thermostat bulb and the thermostat control 29 will switch off the power to the heat exchanger.

An envisaged modification of the above described embodiment is the omission of the cut-out switch 38 which is partially redundant in view of the safety cut-out mode of operation of the thermostat bulb 28. However, this bulb could be placed elsewhere. For instance, it could be placed at the bottom of the rear panel 8 between the panel and the wall, being suitably insulated from the panel. Further, in a particularly simple form, possibly in association with a remote thermostat, the thermostat in the convector heater could be dispensed with.

The ON/OFF switch 37 could also be dispensed with by providing an OFF position for the manually settable control. However, the provision of the ON/OFF switch enables the convector heater to be switched off without the setting of the control being lost. Further the window and lens 33 could be provided in the front panel.

Figure 8:
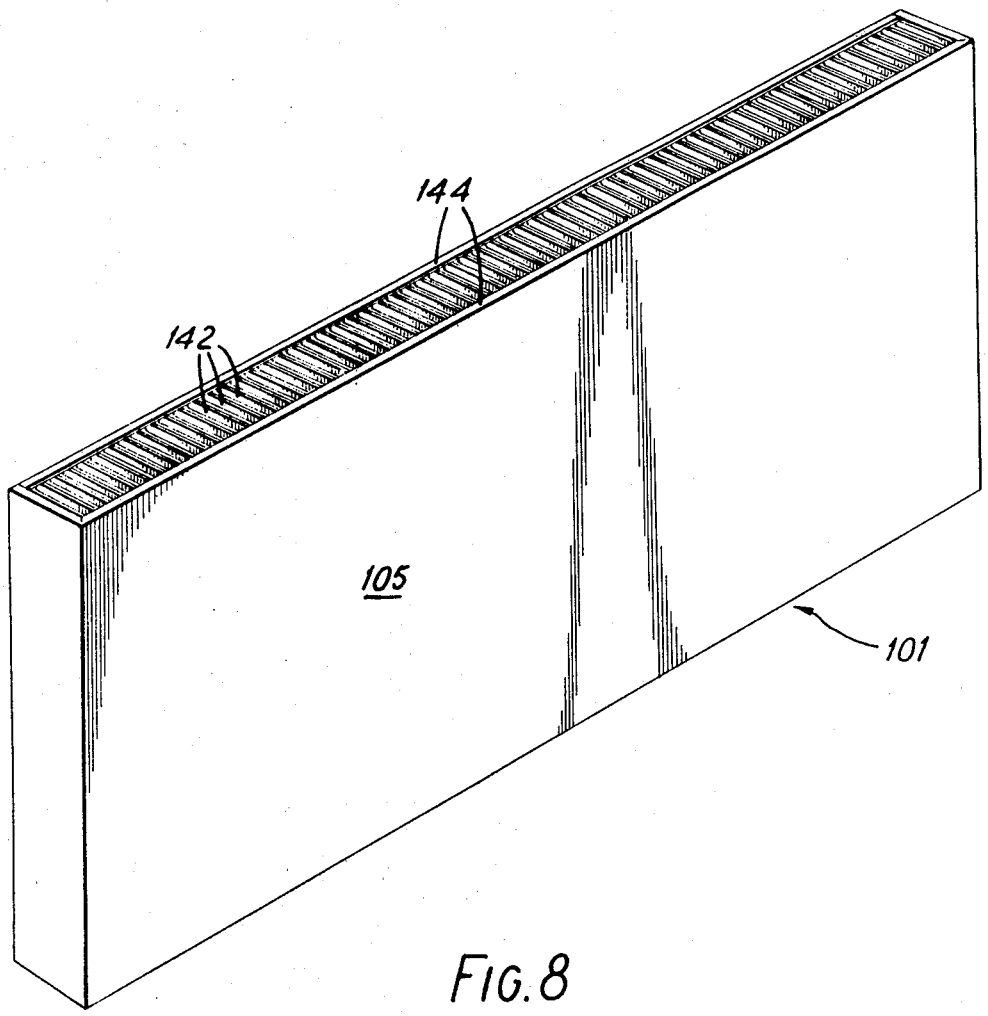
FIG. 8 is a front perspective view from above of a cabinet of a second embodiment of a convector heater in accordance with the invention.
Figure 9:
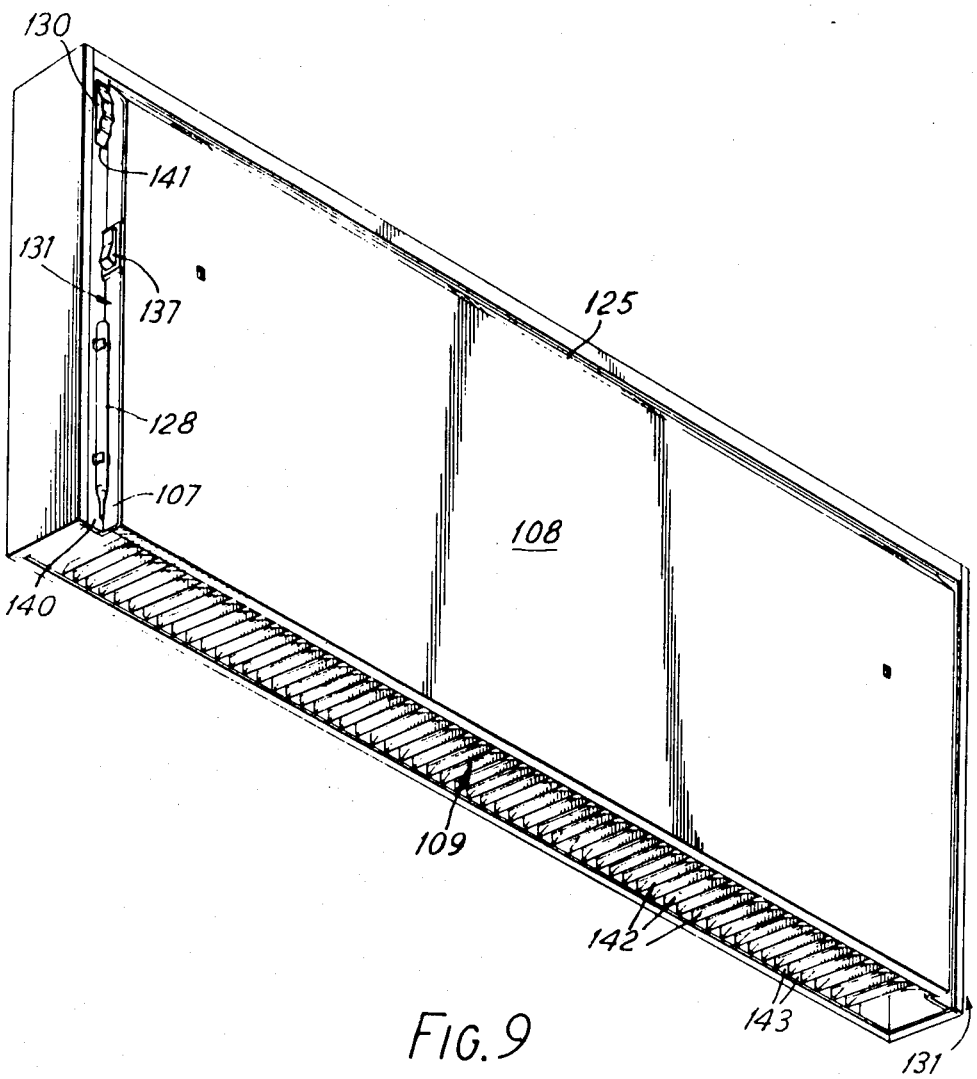
FIG. 9 is a rear perspective view from below of the cabinet of FIG. 8.

An embodiment incorporating a single-thickness sidewall is illustrated in FIGS. 8 and 9. The cabinet 101 of this embodiment has a back panel 108 which is stepped to define rebates 131 at both sides thereof. The rebates are bounded by side portions 107 and extensions 140, which portions and extensions are integral with the back panel 108. The remote edges of the extensions are secured to the rear edges of outer sidewalls 104, which are integral with a front panel 105.

An ON/OFF switch 137 projects into one of the rebates 131 from the respective side portion 107. Above the switch the thumb-wheel 130 of a thermostat control also projects into the one rebate through an opening 141 in the extension 140. A bulb 128 for the thermostat is provided in the rebate below the switch 137.

The cabinet 101 has top and bottom grills 106, 109 in the form of louvred grills both consisting of louvres or fins 142 extending transversely of the elongate direction of the grills. In each grill the fins are stamped from a grill plate around their entire peripheries except near opposite ends where they remain attached to the plate and are bent in at right-angles to the plate, thus offering only their thickness in resistance to convection air flow. The grill plates are welded into the cabinet with the fins extending inwardly of the cabinet. The top and bottom grills 106, 109 are of a different width on account of the deflector 125. However grill plates having the same width of fin are utilized with the top plate being cropped narrower than the bottom plate. The ends of the fins are attached to triangular portions 143 visible in the bottom grill 109. At the top the triangular portions are covered by lips 144 which extend over the edges of the top grill 106.

Finally, it is envisaged that other heat exchangers might be suitable for use with the invention, for instance, suitably mounted coiled wire electrical heating element, and that a thermostat other than one which is bulb operated may be used, e.g. a bimetallic strip thermostat.

I claim:

1. A convector heater for mounting onto a wall, said heater comprising:

heat exchanger means for producing heat;

cabinet means surrounding said heat exchanger means for housing said heat exchanger means therein, said cabinet means comprised of:

a front cabinet having front, side and top portions respectively surrounding the front, sides, and top of said heat exchanger means; and a rear cabinet having rear, bottom and side portions respectively surrounding the rear and bottom and at least part of the sides of said heat exchanger means, said side portions of said rear cabinet being in planes spaced inwardly from planes of said side portions of said front cabinet, and said side portions of said rear cabinet extending rearwardly beyond the rear edge of said front side portions, whereby a rebate is formed on each side of said cabinet means by said inward spacing and said rearward extent of said side portions of said rear cabinet;

control means in one of said rebates and connected to said heat exchanger means for controlling the heat produced by said heat exchanger means; and mounting means connected to said rear cabinet for mounting said cabinet means onto a wall.

2. A convector heater as claimed in claim 1, wherein said side portions of said rear cabinet, which are spaced from said side portions of said front cabinet, are inside of and wider than said side portions of said front cabinet, whereby recesses are formed between said side portions of said front and rear cabinets, said rebate on each side of said cabinet means being formed by said recesses and said rearwardly extending side portions of said rear cabinet.

3. A convector heater as claimed in claim 1, wherein said top portion of said front cabinet and said bottom portion of said rear cabinet have grill-like openings therethrough.

4. A convector heater as claimed in claim 3, wherein said grill-like openings are each provided with a louvred grill.

5. A convector heater as claimed in claim 1, wherein said mounting means positions said cabinet means at a distance from wall, thereby increasing the length of said rebates.

6. A convector heater as claimed in claim 1, wherein said mounting means is comprised of:

at least a pair of vertical supports adapted to be affixed to the wall;

a horizontal bearer extending outward from the bottom of each vertical support and supporting said rear cabinet; and at least one strap connected to one of said vertical supports and to said rear cabinet.

7. A convector heater as claimed in claim 6, wherein each of said vertical supports is a channel support and said strap is contained within a channel of said support when said cabinet means is in an upright position on said mounting means.

8. A convector heater as claimed in claim 1, wherein said control means is comprised of an ON/OFF switch.

9. A convector heater as claimed in claim 1, wherein said control means is comprised of a thermostat.

10. A convector heater as claimed in claim 2, wherein said control means is comprised of a thermostat which has a temperature sensor in one of said recesses.

11. A convector heater as claimed in claim 10, wherein said side portion of said rear cabinet adjacent said temperature sensor in said recess has an opening therethrough into the interior of said rear cabinet where said heat exchanger means is located.

12. A convector heater as claimed in claim 1, wherein said control means is comprised of a thermostat combined with an ON/OFF switch.

13. A convector heater as claimed in claim 1, wherein said control means is comprised of a thermostat and a separate ON/OFF switch.

14. A convector heater as claimed in claim 1, wherein said control means has an adjustable rotatable thumb wheel mounting within said rebate, said thumb wheel being blocked from said view from the front of said cabinet means.

15. A convector heater as claimed in claim 14, wherein said top portion of said front cabinet has a window therethrough above said thumb wheel for viewing said thumb wheel from above.

16. A convector heater as claimed in claim 1, wherein:

said heater exchanger means is comprised of an electric heater; and said rear cabinet has an opening in said rear portion thereof for connecting said electric heater to an electricity source.

17. A convector heater as claimed in claim 1, wherein said rear cabinet further comprises a pair of side extensions, each said side extension being integral with a front edge of a respective said side portion of said rear cabinet and extending outwardly therefrom, in a direction generally parallel to the plane of said rear portion of said rear cabinet, to said side portion of said front cabinet, said rebates on said sides of said cabinet means being formed by said side extensions and said side portions of said rear cabinet, and said control means comprises a thermostat which has a temperature sensor in one of said rebates.

* * * * *